United States Patent [19]

Webster et al.

[11] Patent Number: 5,036,600

[45] Date of Patent: Aug. 6, 1991

[54] CHILL ROLL ASSEMBLY

[75] Inventors: Lawrence D. Webster, Shannock, R.I.; Thomas L. Tarolli, Rocky River, Ohio

[73] Assignee: Harris Graphics Corporation, Dover, N.H.

[21] Appl. No.: 557,201

[22] Filed: Jul. 24, 1990

[51] Int. Cl.[5] ..... F26B 13/08

[52] U.S. Cl. ..... 34/62; 34/66; 34/113

[58] Field of Search ..... 34/13, 62, 66, 113, 34/117, 119

[56] References Cited

U.S. PATENT DOCUMENTS

| | | | |
|---|---|---|---|
| 2,366,563 | 1/1945 | Shaw | 34/62 |
| 4,476,636 | 10/1984 | Gross | 34/114 |
| 4,774,771 | 10/1988 | Littleton | 34/62 |

OTHER PUBLICATIONS

System 3, Littleton Industrial Consultants, Inc., dated 1983.

*Primary Examiner*—James C. Yeung

*Attorney, Agent, or Firm*—Tarolli, Sundheim & Covell

[57] ABSTRACT

A chill roll assembly for a printing press scrubs away boundary layers of air and vapors adhered to both side surfaces of a paper web moving through the chill roll assembly. The chill rolls are supported on separate frames which are adjustable relative to one another. Adjustment of the frames moves the chill rolls into and out of positions in which surfaces of the web sections moving in opposite directions around the rolls are held in closely spaced relationship to define a zone of interference. The boundary layers adhering to the closely spaced surfaces of the moving web sections are scrubbed away in the zone of interference.

14 Claims, 2 Drawing Sheets

10
40
42
14
41
44
18
39
32
38
28
42
12
30
36
37
44
35
14
42
34
42
44
16
26
22
24
20

CHILL ROLL ASSEMBLY

FIELD OF THE INVENTION

The present invention relates to printing on a web of paper, and particularly relates to a chill roll assembly for cooling a web of printed paper.

BACKGROUND OF THE INVENTION

A printing press applies ink to an elongated web of paper as the web of paper is moved lengthwise through the printing press. The freshly printed paper web is moved through a drier, and is then moved through a chill roll assembly in order to cool the heated web and to set the ink. A chill roll assembly comprises a succession of rolls which are cooled by water circulating through the interior of the rolls.

As the paper web moves from the drier to the chill roll assembly, boundary layers of air adhere to the opposite side surfaces of the moving web and are carried along with the moving web. Vaporized chemical solvents and ink residue become trapped in the boundary layers on the side surfaces of the moving web as the web emerges from the drier, and are carried by the boundary layers toward the chill roll assembly.

As the moving web proceeds around the rolls in the chill roll assembly, the boundary layers have detrimental effects on the quality of the printed image on the web. The boundary layers adhering to the web surfaces are carried around the rolls in the chill roll assembly between the web surfaces and the roll surfaces. The boundary layers thereby insulate the heated surfaces of the web from the cooled surfaces of the rolls and inhibit heat transfer from the web to the rolls. Furthermore, the vaporized ink and chemical solvents in the boundary layers are deposited as residue on the roll surfaces as the web moves through the chill roll assembly. Ink residue accumulating on the roll surfaces can be transferred back onto the web to soil the printed web surfaces which follow.

U.S. Pat. No. 4,476,636 shows a means for clearing away the boundary layers on both sides of a printed paper web moving through a chill roll assembly. The chill roll assembly includes a pair of small boundary layer control rolls in sliding contact with the opposite side surfaces of the moving paper web. Each boundary layer control roll rotates in a direction opposite to the direction of the web sliding over the roll. A boundary layer carried on the web surface is squeezed off as the web surface slides against the boundary layer control roll.

Another known means for clearing away the boundary layer on the surface of a moving paper web in a chill roll assembly uses one of the chill rolls to affect the boundary layer instead of using a separate boundary layer control roll. In such a chill roll assembly, the paper web follows a horizontal path from the drier to the first one of the chill rolls, and continues in a serpentine path around the successive chill rolls. The chill rolls are mounted on a frame. The frame is pivotal about an axis in order to move the chill rolls relative to the horizontal web section extending from the oven to the first chill roll. The position of the frame can be adjusted to move the second chill roll into a position closely adjacent to the horizontal web section. The web section moving around the second chill roll is thus closely spaced from the horizontal web section. The closely spaced web sections move in opposite directions relative to one another. The closely spaced positions of the oppositely moving we sections define a zone of interference in which the boundary layers on the oppositely moving web sections are scrubbed or squeezed away. However, this arrangement of chill rolls affects only one side of the moving web.

An arrangement of chill rolls for scrubbing the boundary layers on both sides of the moving web is shown in U.S. Pat. No. 4,774,771. This patent shows four chill rolls mounted on a frame. The second and third chill rolls are adjustable on the frame. The axles of the second and third chill rolls are mounted at each end in an eccentric. Each of the eccentrics is adjustable on the frame to move the associated axle end horizontally and vertically on the frame. Adjustment of both ends of the second chill roll axle moves the second chill roll into a position closely spaced from the horizontal web section moving from the drier to the first chill roll. A first zone of interference is thereby defined for scrubbing the boundary layer on the upper side surface of the web. Adjustment of both ends of the third chill roll axle moves the third chill roll into a position closely spaced from the web section moving between the first chill roll and the second chill roll. A second zone of interference is thereby defined for scrubbing the boundary layer on the lower side surface of the web. However, the opposite ends of the movable chill roll axles must be carefully adjusted to maintain the chill rolls in parallel relationship and to define uniform zones of interference across the width of the web.

SUMMARY OF THE INVENTION

The present invention provides a chill roll assembly in which a printed web carrying a boundary layer is moved along a path between and around a succession of rotating chill rolls for transferring heat from the web. The chill roll assembly comprises a chill roll rotatable in a first direction, a successive chill roll also rotatable in the first direction, and means for supporting the chill rolls. The supporting means supports the successive chill roll in a position closely adjacent to the other chill roll. The closely spaced positions of the adjacent chill rolls define a zone of interference. A boundary layer on web sections moving in relatively opposite directions around the adjacent chill rolls through the zone of interference is scrubbed away from the web.

The arrangement of chill rolls in accordance with the invention defines a zone of interference at a location where both of the web sections which carry the scrubbed portions of the boundary layer are moving around chill rolls, as opposed to prior art arrangements wherein zones of interference are defined only at locations where one of the web sections is moving around a chill roll and the other is moving between two successive chill rolls. In the prior art, the web section moving between chill rolls extends tangentially to the web section moving in an arcuate path around the adjacent chill roll, whereas in the present invention, each web section extends in an arcuate path which is opposed to the arcuate path of the web section moving around the closely spaced adjacent chill roll. The opposed arcuate paths of the web sections define a space for dispersion of the scrubbed away boundary layer in a direction outwardly of the nip between the closely spaced chill rolls. The space between the opposed arcuate web sections is greater than the space between a tangential web section and an adjacent arcuate web section.

In a preferred embodiment of the invention, the chill rolls are supported on two separate frames. The first frame supports first and second chill rolls. The second frame supports third and fourth chill rolls. The second frame is pivotal about an axis for adjustment relative to the first frame Adjustment of the second frame adjusts the position of the third chill roll relative to the first chill roll. The third chill roll can be moved into a position wherein the boundary layer on the web sections moving around the first and third chill rolls will be scrubbed away. The extent to which the boundary layer will be scrubbed away is controlled by adjustment of the second frame relative to the first frame. Importantly, the chill rolls are supported at fixed positions on the frames. Instead of separately adjusting each end of a chill roll axle as in the prior art, the chill rolls in accordance with the present invention are adjusted simply by adjusting the relative positions of the frames. The chill rolls remain parallel, and the zones of interference have a uniform depth across the width of the web. A uniform zone of interference results in uniform scrubbing of a boundary layer.

BRIEF DESCRIPTION OF THE DRAWINGS

These and other features of the present invention will become apparent to those skilled in the art upon reading the following description of a preferred embodiment in view of the accompanying drawings wherein.

DESCRIPTION OF A PREFERRED EMBODIMENT

Figure 1:
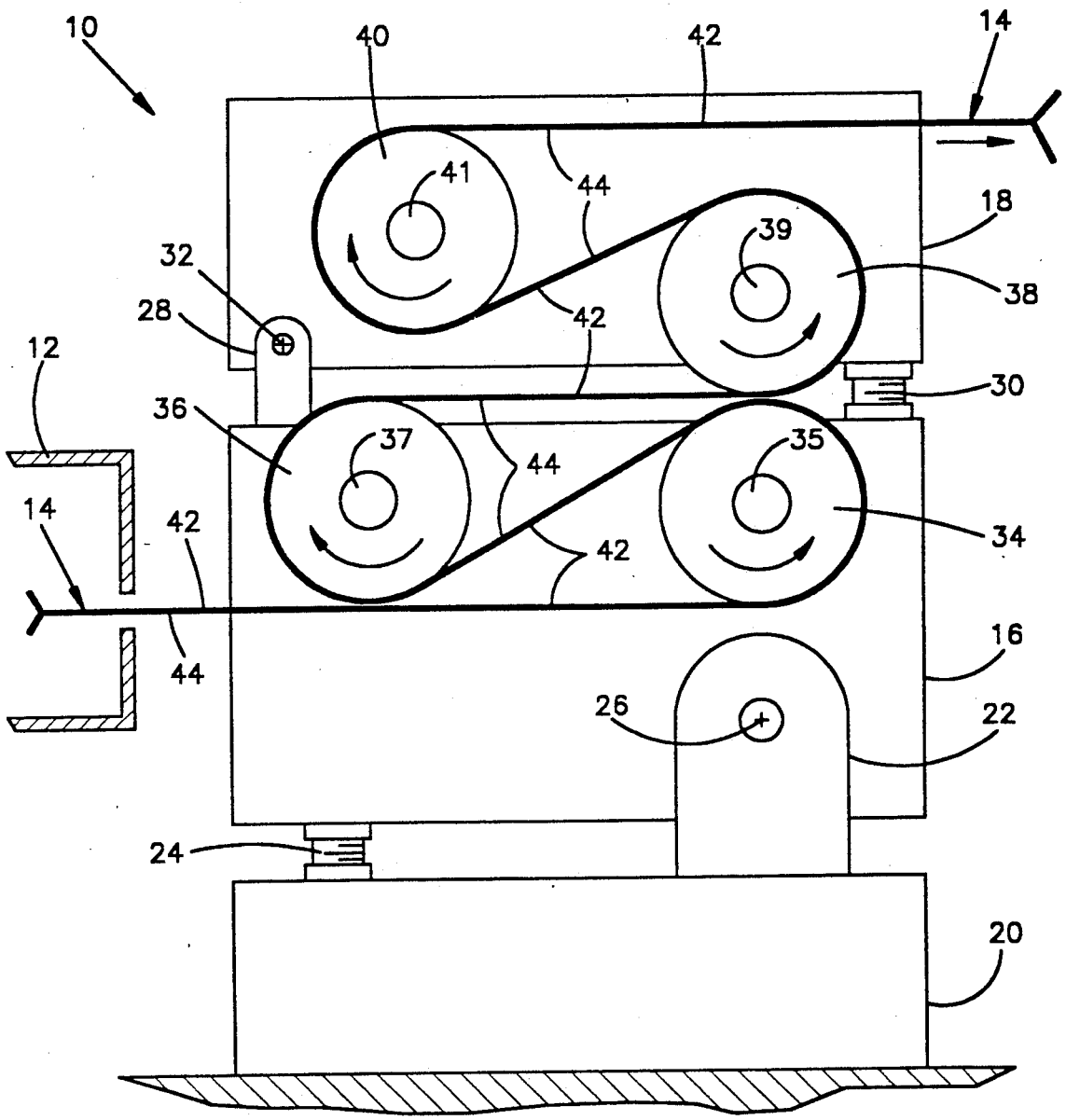
FIG. 1 is a schematic view of a chill roll assembly in accordance with the present invention.

In FIG. 1 there is shown a chill roll assembly 10 in accordance with the present invention, a drier 12, and a paper web 14. After an inked image is applied to each side surface of the web 14 in a printing press, the web 14 is moved through the drier 12 to dry the ink on the surfaces of the web 14. The web 14 is then moved through the chill roll assembly 10 in order to cool the web 14 and to set the ink.

The chill roll assembly 10 comprises a first frame 16, a second frame 18, and a base 20. The first frame 16 is supported on the base 20 by a first bearing assembly 22 and a first turnbuckle assembly 24. The first bearing assembly 22 supports the first frame 16 for pivotal movement about an axis 26, and the first turnbuckle assembly 24 adjusts the pivotal position of the first frame 16 relative to the base 20. The second frame 18 is supported on the first frame 16 by a second bearing assembly 28 and a second turnbuckle assembly 30. The second bearing assembly 28 supports the second frame 18 for pivotal movement about an axis 32, and the second turnbuckle assembly 30 adjusts the pivotal position of the second frame 18 relative to the first frame 16.

A first chill roll 34 and a second chill roll 36 are supported on the first frame 16. The first chill roll 34 has an axle 35 mounted at a fixed position on the first frame 16, and is driven to rotate in a counterclockwise direction as shown in the Figures. The second chill roll 36 has an axle 37 mounted at a fixed position on the first frame 16, and is driven to rotate in a clockwise direction as shown in the Figures. A third chill roll 38 having an axle 39 and a fourth chill roll 40 having an axle 41 are similarly supported at fixed positions on the second frame 18. The third chill roll 38 is driven to rotate in a counterclockwise direction as shown in the Figures, and the fourth chill roll 40 is driven to rotate in a clockwise direction. The web 14 extends in a horizontal path from the drier 12 to the first chill roll 34, and continues around and between the successive chill rolls 34, 36, 38 and 40 in the serpentine path shown in FIG. 1. The chill rolls 34, 36, 38 and 40 all rotate with a surface speed equal to the speed of the web 14 emerging from the drier 12 in order to move the web 14 through the chill roll assembly 10. Water or another coolant liquid is circulated through the chill rolls in a conventional manner by a circulating means (not shown).

Figure 2:
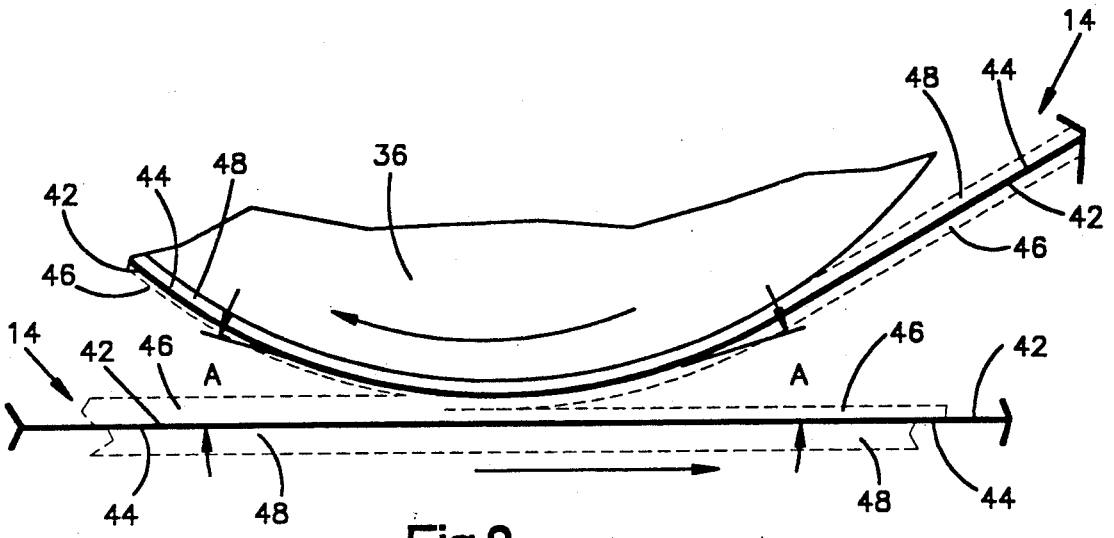
FIG. 2 is an enlarged partial view of the chill roll assembly of FIG. 1.

As the moving web 14 emerges from the drier 12, a boundary layer of air 12 adheres to each opposite side surface 42, 44 of the web 14. The boundary layers contain ink residue and vaporized chemical solvents which are evaporated from the freshly printed web 14 as the web passes through the drier 12. As shown in FIG. 2, an upper boundary layer 46 adheres to the upper side surface 42 of the web 14, and a lower boundary layer 48 adheres to the lower side surface 44 of the web 14.

In accordance with the invention, the first and second frames 16 and 18 are adjustable to place the second and third chill rolls 36 and 38 in positions for scrubbing the upper and lower boundary layers 46 and 48 off of the web 14. Pivotal movement of the first frame 16 about the axis 26 by adjustment of the first turnbuckle assembly 24 moves the second chill roll 36 relative to the horizontal section of the web 14 moving between the drier 12 and the first chill roll 34. The position of the first frame 16 can be adjusted to place the second chill roll 36 in the position shown in FIG. 2. When the second chill roll 36 is in the position shown in FIG. 2, the upper side surface 42 of the web section moving around the second chill roll 36 is closely spaced from the upper side surface 42 of the horizontal web section moving in the opposite direction from the drier 12 to the first chill roll 34. The closely spaced positions of the second chill roll 36 and the horizontal web section thereby define a zone of interference. The boundary layer 46 moving to the right as shown in FIG. 2 and the downstream portion of the same boundary layer 46 which is moving to the left as shown in FIG. 2 are scrubbed away from the closely spaced web sections moving through the zone of interference. Each scrubbed portion of the boundary layer 46 will therefore become thinner as it moves through the zone of interference, as shown in exaggerated proportions in FIG. 2. The angle A defines a clearance between adjacent moving sections of the web 14 for dispersion of the scrubbed portions of the upper boundary layer 46 adhering to the upper side surface 42 of the web 44.

Figure 3:
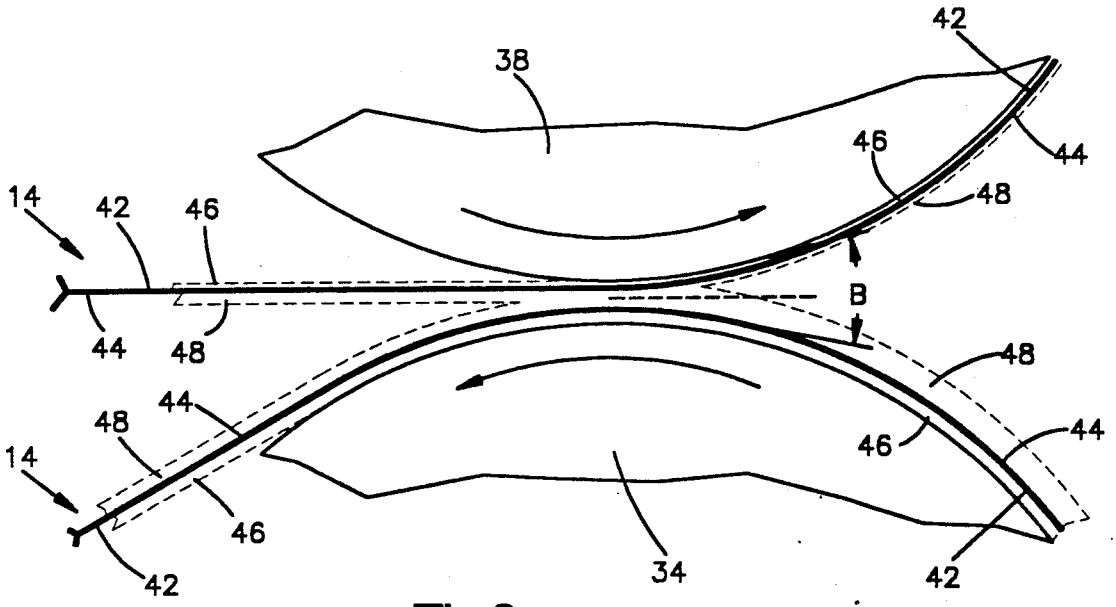
FIG. 3 is an enlarged partial view of another portion of the chill roll assembly of FIG. 1.

Movement of the second frame 18 about the axis 32 by adjustment of the second turnbuckle assembly 30 moves the third chill roll 38 relative to the first chill roll 34. The third chill roll 38 can thus be moved into the position shown in FIG. 3. When the third chill roll 38 is in the position shown in FIG. 3, the web section moving around the third chill roll 38 is closely spaced from the web section moving in the opposite direction around the first chill roll 34. The closely spaced positions of the third chill roll 38 and the first chill roll 34 thereby define a second zone of interference in the area of the nip between the two chill rolls 34 and 38. The boundary layer 48 adhering to the lower side surface 44 of the web section moving around the first chill roll 34 and the downstream portion of the same boundary layer 48 moving around the third chill roll 38 are scrubbed away from the closely spaced web sections moving through the second zone of interference. Each portion of the boundary layer 48 moving through the second zone of interference will become thinner, as indicated in FIG. 3. The angle B between the opposed arcuate web sections moving around the first and third chill rolls 34 and 38 defines a space for dispersion of the scrubbed portions of the boundary layer 48. The space defined by the angle B is approximately twice as large as the space defined by the angle A shown in FIG. 2. Vapors and residue scrubbed away from the web 14 are therefore dispersed throughout a larger space, and have a lesser tendency to be caught and carried back toward the web surfaces by the adjacent moving boundary layers.

From the above description of the invention, those skilled in the art will perceive improvements, changes and modifications. Such improvements, changes and modifications are covered by the appended claims.

Having described the invention, the following is claimed:

1. A chill roll assembly for transferring heat from a printed web carrying a heated boundary layer, said chill roll assembly comprising:

a plurality of chill rolls for moving the web in arcuate paths around individual chill rolls and in linear paths between adjacent chill rolls, including first and second chill rolls rotatable in a first direction; and means for supporting said first and second chill rolls in positions closely adjacent to each other to define a nip between said first and second chill rolls, and to define a zone of interference at said nip in which a portion of a heated boundary layer on a web section moving in an arcuate path around said first chill roll and another portion of the heated boundary layer on a web section moving in an arcuate path around said second chill roll are scrubbed away from the web.

2. A chill roll assembly as defined in claim 1 wherein said supporting means includes means for adjusting said positions of said first and second chill rolls to adjust said zone of interference.

3. A chill roll assembly as defined in claim 2 wherein said first and second chill rolls each have opposite ends, said adjusting means moving the opposite ends of one of said first and second chill rolls simultaneously and equally relative to the opposite ends of the other of said first and second chill rolls.

4. A chill roll assembly in which a printed web carrying a heated boundary layer is moved along a path between and around a succession of rotating chill rolls for transferring heat from the web, said chill roll assembly comprising:

a first chill roll rotatable in a first direction;

a first frame supporting said first chill roll at a fixed position on said first frame;

a successive chill roll rotatable in said first direction;

a second frame supporting said successive chill roll at a fixed position on said second frame; and means for adjusting the position of said second frame relative to said first frame to adjust the position of said successive chill roll relative to said first chill roll, said second frame being movable into and out of a position in which said successive chill roll is closely adjacent to said first chill roll to define a zone of interference in which a portion of a heated boundary layer on a web section moving around said first chill roll and a downstream portion of such heated boundary layer on a web section moving in the opposite direction around said successive chill roll are scrubbed away from such web sections.

5. A chill roll assembly as defined in claim 4 wherein said successive chill roll is a third chill roll, and further comprising a second chill roll at a location in said path between said first and third chill rolls, said second chill roll being supported at a fixed position on said first frame.

6. A chill roll assembly in which a printed web having opposite side surfaces carries a heated boundary layer on each side surface and is moved around a succession of chill rolls for transferring heat from the web, said chill roll assembly comprising:

a base;

a first frame supported on said base;

a first chill roll rotatable in a first direction, said first chill roll being supported at a fixed position on said first frame;

a second chill roll rotatable in a second direction opposite to said first direction to receive the web from said first chill roll, said second chill roll being supported at a fixed position on said first frame;

means for adjusting the position of said first frame relative to said base to move said second chill roll into and out of a position in which a web section moving around said second chill roll is closely spaced from an adjacent web section moving in an opposite direction to define a first zone of interference in which a heated boundary layer on one side surface of the web is scrubbed away from such web sections;

a second frame supported on said first frame;

a third chill roll rotatable in said first direction to receive the web from said second chill roll, said third chill roll being supported at a fixed position on said second frame; and means for adjusting the position of said second frame relative to said first frame to move said third chill roll into and out of a position in which a web section moving around said third chill roll is closely spaced from an adjacent web section moving in an opposite direction around said first chill roll to define a second zone of interference in which a heated boundary layer on the other side surface of the web is scrubbed away from such web sections.

7. A chill roll assembly as defined in claim 6 wherein said first frame has a first axis which is fixed relative to said base, said first adjusting means moves said first frame to pivot about said axis, said second frame has a second axis which is fixed relative to said first frame, and said second adjusting means moves said second frame to pivot about said second axis.

8. A chill roll assembly in which a printed web carrying a heated boundary layer is moved along a path between and around a succession of rotating chill rolls for transferring heat from the web, said chill roll assembly comprising:

one of said chill rolls rotatable in a first direction;

a successive chill roll rotatable in said first direction;

means for supporting said successive chill roll in a position closely adjacent to said one chill roll to define a zone of interference in which a portion of a heated boundary layer on a web section moving around said successive chill roll and another portion of the heated boundary layer on a web section moving around said one chill roll are scrubbed away from the web, including a first frame supporting said first chill roll at a fixed position on said first frame, and a second frame supporting said second chill roll at a fixed position on said second frame; and means for adjusting said position of said successive chill roll with respect to the position of said one chill roll, including means for moving said first frame relative to said second frame.

9. A chill roll assembly as defined in claim 8 wherein said one chill roll is a first of three chill rolls, said successive chill roll is the third of said three chill rolls, and further comprising means for supporting the second of said three chill rolls in a position to define another zone of interference in which another heated boundary layer is scrubbed away from the web.

10. A chill roll assembly as defined in claim 9 further comprising means for adjusting said position of said second chill roll.

11. A chill roll assembly as defined in claim 10 wherein said second chill roll is supported at a fixed position on said first frame, and said adjusting means includes means for moving said first frame relative to a web section moving toward said first chill roll.

12. A chill roll assembly as defined in claim 11 further comprising a base which supports said first frame at a position vertically above said base, said first frame supporting said second frame at a position vertically above said first frame.

13. A chill roll assembly for moving and transferring heat from a printed web having opposite side surfaces and a heated boundary layer on each side surface, said chill roll assembly comprising:

first and second chill rolls for moving and transferring heat from the web;

a first frame for supporting said first chill roll in a position in which a web section moving around said first chill roll in one direction is closely spaced from a web section moving in the opposite direction to define a first zone of interference in which a heated boundary layer on one side surface of the web is scrubbed away from the web;

a second frame for supporting said second chill roll in a position in which a web section moving around said second chill roll in one direction is closely spaced from a web section moving in the opposite direction to define a second zone of interference in which a heated boundary layer on the opposite side surface of the web is scrubbed away from the web; and means for adjusting said positions of said first and second chill rolls, including means for adjusting the position of said first frame relative to the position of said second frame.

14. A chill roll assembly as defined in claim 13 wherein adjustment of the positions of said frames relative to each other moves the opposite ends of said first chill roll equally relative to the opposite ends of said second chill roll.

* * * * *